US005425512A

United States Patent [19]

Bichot et al.

[11] Patent Number: 5,425,512

[45] Date of Patent: Jun. 20, 1995

[54] ROLL OF COMPRESSED FIBROUS MAT, METHOD AND DEVICE FOR OBTAINING IT

[75] Inventors: Bernard Bichot, Clermont; Bernard Louis, Liancourt, both of France; Hugo Romer, Worms, Germany; Werner Siegel, Osthofen, Germany; Friedrich Kaufmann, Limburgerhof, Germany

[73] Assignee: Isover Saint Gobain, Courbevoie, France

[21] Appl. No.: 1,680

[22] Filed: Jan. 7, 1993

[30] Foreign Application Priority Data

Jan. 7, 1992 [FR] France ..... 92 00064

[51] Int. Cl.[6] ..... B65H 18/22

[52] U.S. Cl. ..... 242/541.3; 242/541.2

[58] Field of Search ..... 242/55, 55.1, 67.1 R, 242/67.2, 67.3 R, DIG. 3, 541.2, 541.3; 100/40, 76, 88

[56] References Cited

U.S. PATENT DOCUMENTS

| | | | |
|---|---|---|---|
| 546,009 | 9/1895 | Graves | 242/55.1 |
| 2,057,191 | 10/1936 | Huffine | 242/67.1 R |
| 2,775,410 | 12/1956 | Schwartz et al. | 242/DIG. 3 |
| 4,022,003 | 5/1977 | Strausser et al. | 100/88 X |
| 4,034,928 | 7/1977 | McDonald et al. | 242/59 |
| 4,114,530 | 9/1978 | Miller | 242/67.1 R |
| 4,164,177 | 8/1979 | Canfield | 242/55 X |
| 4,365,767 | 12/1982 | Benthimere | 242/67.1 R |
| 4,583,697 | 4/1986 | Bichot et al. | 242/55.1 |
| 4,602,471 | 7/1986 | Gray et al. | 100/88 X |
| 4,653,397 | 3/1987 | Gray et al. | 100/76 |
| 4,830,808 | 5/1989 | Bichot et al. | 242/67.1 RX |
| 4,913,764 | 4/1990 | Bichot et al. | 156/446 |
| 4,928,898 | 5/1990 | Audren et al. | 242/55.1 |
| 4,972,770 | 11/1990 | Berkers | 100/88 X |
| 4,973,010 | 11/1990 | Brown | 242/67.1 R |
| 5,022,597 | 6/1991 | Morizzo | 242/56 R |
| 5,167,738 | 12/1992 | Bichot et al. | 156/62.4 |

FOREIGN PATENT DOCUMENTS

| | | | |
|---|---|---|---|
| 1033601 | 7/1953 | France | 242/67.1 R |
| 62-31644 | 2/1987 | Japan | 242/54 R |

*Primary Examiner*—John P. Darling

*Attorney, Agent, or Firm*—Oblon, Spivak, McClelland, Maier & Neustadt

[57] ABSTRACT

A winder intended for compressing a fibrous mat 4 rolls the mat up on itself and wraps it so as to store it and transport it with a reduced bulk. The machine has two belts 1, 2 supported by two fixed rollers 9, 13 and two mobile rollers 14, 15. The tension of the belts and the position of the mobile rollers are managed by a computer. The winding speed and the admissible compression ratio without damaging the fibrous mat are better than with the winder of the prior art.

14 Claims, 5 Drawing Sheets

ROLL OF COMPRESSED FIBROUS MAT, METHOD AND DEVICE FOR OBTAINING IT

BACKGROUND OF THE INVENTION

1. Field of the Invention

The invention relates to techniques for compressing and then winding fibrous mats so an to allow them to be wrapped and packed until they reach their place of use. The flexible fibrous mats, in particular those consisting of glass wool or rock wool intended for insulation, are usually wound up on themselves in a very tight manner so as to prevent them from occupying too great a volume during their transport. The greater the compression ratio of the fibrous mat, the cheaper the transport and storage.

2. Description of the Related Art

In general, production lines operate continuously and deliver mats of indefinite length. The latter are cut so as to provide rolls whose width and length correspond to the needs of the user. On insulating glass mat production lines there are winders whose operation is more or less automated.

In order to fulfill their functions, these machines must possess a certain number of basic characteristics. They must compress the wool mats as much as possible and in the same manner over their entire length, but they must also avoid damaging the fiber and the binder which constitute the insulating mat.

Moreover, it is important for the series of operations to be performed at a sufficient speed to be compatible with the output speed of the mat. This point is particularly important for modern lines whose production capability it is often desired to increase. In order to do this, many upstream units for producing glass or rock fibers are used, all these units successively feeding the same mat whose output speed depends, other things being equal, upon the number of machines upstream. From this point of view it is particularly important for the winders to avoid non-productive times. The ideal winder would be a machine which would wind the mat at the speed at which it passes down the production line without any non-productive time between the end of one mat and the beginning of the next mat. Thus the winding speed would be minimal and would avoid all the drawbacks such as premature wear, breakdown and so on.

SUMMARY OF THE INVENTION

One object of the invention is to provide a winder in which the nonproductive times are reduced to a minimum.

In order to decrease the transport costs, vary high compression ratios must be reached without damaging the fibrous mat. Another object of the invention is to provide fibrous mats wound up on themselves with high compression ratios and which recover all their original characteristics upon being decompressed.

It is also an object of the invention to provide a winder which in no way damages the fibers and the binder of the fibrous mat during compression.

The rolls of mineral fiber mats which can be obtained with the winders of the prior art are limited, in the case of specific masses of 8 to 10 kg/m$^3$, to compression ratios of least than 7/1 if the compression is produced in a single operation and to compression ratios of between 6 and 8/1 with methods comprising two mechanical stages or one mechanical stage and one vacuum stage.

Existing winders are of two types: either the elements between which the winding takes place are essentially plane elements, or winding is carried out inside a substantially circular cavity.

One winder of the first type is described for example in the patent EP 294 290. It comprises two plane rolling belts combined so as to form a dihedron which is permanently tangential to the fibrous roll being formed. The compression of the fibrous mat is exerted by a mobile roller whose position and rotational speed go through very precise programs. This type of winder exhibits two types of drawbacks. Firstly, the pressure is only exerted on the fibrous roll being formed at well determined places. Between these compression zones, the fibrous mat relaxes so as to be compressed again a little further on.

This alternate pressure/relief on the fibers may bring about their breakage and moreover, the binder which combines the fibers together undergoes fatigue which may lead to its damage in some places. The second drawback of this type of winder results from its discontinuous operation. At the end of the operation for winding a first fibrous roll, the pressing roller must be moved away so as to allow removal of the fibrous roll and it is only after it is returned that the following operation of beginning winding of a new fibrous roll can take place.

A second type of winder has been developed. It uses either a single wide belt or two groups of narrow belts for pressing on the fibrous roll to form a sort of circular cavity around the fibrous roll.

This technique is described for example in U.S. Pat. No. 4,602,471. The fibrous mat transported by a belt conveyor is forced, before entering the winder, to pass under a plate which compresses it during transport onto the last belt conveyor which precedes the winder proper. The compressed mat then enters the loop formed by the free belt held by two fixed rollers. This system has the advantage of avoiding the compression/-decompression phases of the previous type of winder. Breakages of the fibers and fatigue of the binder are thus avoided. But damage to the fibers, however, remains; this is due to the fact that before entering the circular cavity the fibrous mat transported by the plane belt conveyor exerts continuous friction on the upper plate during its compression. Aside from the fact that it consumes a lot of energy, this friction may give rise to damage to the fibers of the mat of mineral wool or glass wool. A second difficulty of this type of winder results from the fact that at the and of the winding operation it is necessary to move away the two rollers which close the cavity so as to allow the newly formed fibrous roll to be removed. The time necessary is thus added to the duration of winding.

U.S. Pat. No. 4,034,928 describes a winder which is devoted to winding of flexible thin films around a central spindle. During the winding, the film roll is rotated by two groups of many narrow belts pressing each one on about one half of its periphery. Besides the fact that such machine winding of incompressible films has nothing to do with compression and decompression problems, it does not suppress the non-productive times between the end of the winding of a roll and the beginning with the next film. On the other hand the central spindle on which the films adheres by way of suction would be incompatible with porous fibrous mat.

The invention provides a roll of compressed insulating mat based on mineral fibers and having an original specific mass of 8 to 10 kg/m$^3$ whose compression ratio is at least 8.5 to 1.

The invention deals with a winder for winding up a flexible band on itself where the forming roll is rotated by two flexible means, each of them closely holding about one half of the roll periphery, in which the flexible band is a compressed fibrous mat, and where each of the two flexible means includes a large belt. In the winder of the invention, the removal of the roll of compressed mat is carried out in the same direction as the introduction of the compressed fibrous mat into the winder. On the other hand, the compressed fibrous mat is elaborated by compression of the mat without slip between the mat and pressing members which are preferably two conveyor belts.

In the winder according to the invention, a device such as a metal plate holds the mat in a compressed state after it leaves the pressing members and until it reaches the previous turn of the roll. The compressed mat preferably joins the roll tangentially to its periphery. On the other hand, the large belts closely holding the forming roll periphery are guided by four rollers, and possibly a fifth roller, which facilitates starting the winding and cooperates with it.

At a given moment, at least three of the four yielding rollers are tangential to a cylinder whose directrix has substantially the shape of a spiral corresponding to the theoretical envelope of the compressed roll at that same moment and a wrapping film is wound simultaneously with the last turn of the roll of compressed mat. Its length is greater than that of the development of the last turn of the roll of compressed mat, and it is coated with adhesive at both ends on its internal face.

In a preferred mode of the winder of the invention, at the end of winding, when the two downstream rollers free the roll of compressed mat, two now rollers are positioned without delay. The advance of the leaving rollers and that of the two new rollers is carried out in the same direction.

This is preferably done when the rollers are connected to rotating systems of the carousel type which support them.

The roll of fibrous mat of the invention with high compression ratio makes it possible to produce significant savings in the transport and storage of insulating mats.

The technique of the invention makes it possible to exert a pressure during winding which is constant both in time and in space, thus avoiding the alternating compression and relaxation which damages the fibers and brings about binder fatigue. The fact of making the fibrous roll pass through the device according to the invention rather than exerting a to-and-fro movement also makes it possible to very substantially reduce the non-productive times.

An important advantage also results from the fact that, by virtue of the device of the invention, the compressed roll is directly wound in the film which holds it in place, thus avoiding any re-run, or any release of the pressure while limiting the non-productive times.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
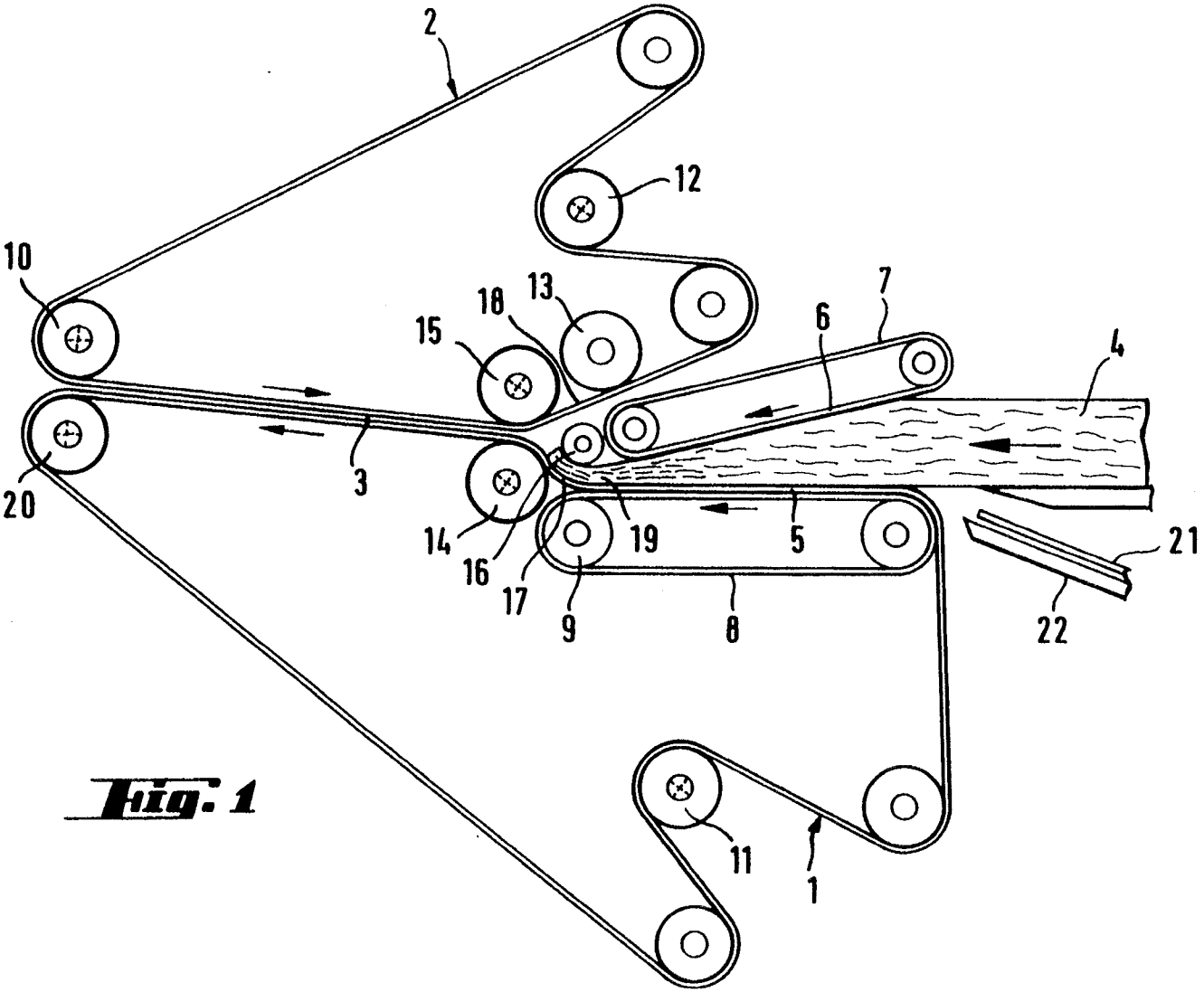
FIG. 1 shows the device of the invention before starting to wind the fibrous mat up on itself.

Referring now the drawings, wherein like reference numerals designate identical or corresponding parts throughout the several views, and more particularly to FIG. 1 thereof;

In FIG. 1 the essential elements of the device of the invention can be seen. There can be seen at 1 a first rolling belt whose shape varies throughout the winding operation. The same applies to the second rolling belt 2. Before the start of winding the two belts follow a rectilinear path 3 in opposite directions. In order to facilitate understanding of the device the rollers supporting those rolling belts, whose position does not vary during the entire winding operation, have been shown as circles around their axes. In contrast, those rollers whose axes are shown by crosses in broken lines have a position which changes during the duration of the winding of the fibrous mat.

At 4 can be seen the fibrous mat being fed from the production line, which fibrous mat is compressed between two planes acting as feeding means. The first plane consists of part 5 of the rolling belt 1; the second consists of part 6 of another rolling belt 7. The two plane elements 5 and 6 move at substantially the same speed which is the output speed of the fibrous mat 4 from the production line. This part of the device therefore makes it possible to avoid any relative movement between the fibrous mat and therefore the fibers of the fibrous mat on the one hand, and the belts which compress them, on the other hand. Thus any friction which would risk damaging the fibers is avoided.

In one embodiment of the invention plane part 5 of the rolling belt 1 is, in reality, supported by a second rolling belt 8, the upper part of which support, over its entire length, the rectilinear part 5 of the rolling belt 1. It is advantageous to use this conveyor belt 8 not only for supporting the rolling belt 1 but also for entraining it in its translational movement. The roller 9 is therefore advantageously used for supporting both the conveyor belt 8 and the rolling belt 1. The rotational movement of this roller 9 has a constant speed during winding. The rolling belt 2 is entrained by one of its support rollers upstream of the winding cavity, for example the roller 10. Its speed is also constant during winding. On the other hand, the tension of the rolling belts 1 and 2 is provided respectively by the roller 11 and the roller 12, whose positions are controlled by a central computer at each moment.

The cavity in which the winding of the compressed fibrous mat takes place is defined by five rollers and two rolling belt elements. Amongst the rollers, two are fixed: the roller 9 which has already been mentioned and roller 13 which guides the rolling belt 2. During the entire winding, the rollers 14 and 15 respectively supporting the rolling belts 1 and 2 move along two parallel rectilinear paths parallel to path 3 so as to free a length 17 of belt 1 (and 18 for the belt 2) to constitute the circular wall of the cavity where the winding of the compressed mat will take place.

The small mobile roller 16 exercises a specific function at the start of the operation. At the instant when the end of a new segment of compressed mat 19 enters the cavity, the roller 16 occupies a position which allows the end of mat 19 to penetrate very far forward into the cavity. This position is determined by the thickness of the mat to be wound. The purpose of the roller 16 is to close the cavity at the beginning of winding and to allow the formation of the first turn. For a felt of a given type, the position of the roller 16 is fixed.

At that instant, the rollers 14 and 15 begin to move towards the left of the figure, i.e., towards the roller 10 and its twin roller 20. This movement is also managed by the computer so that the four rollers 9, 14, 15 and 13 occupy theoretical positions at the periphery of the compressed fibrous mat; that is to say they are tangential to a cylinder with a spiral directrix.

Figure 2:
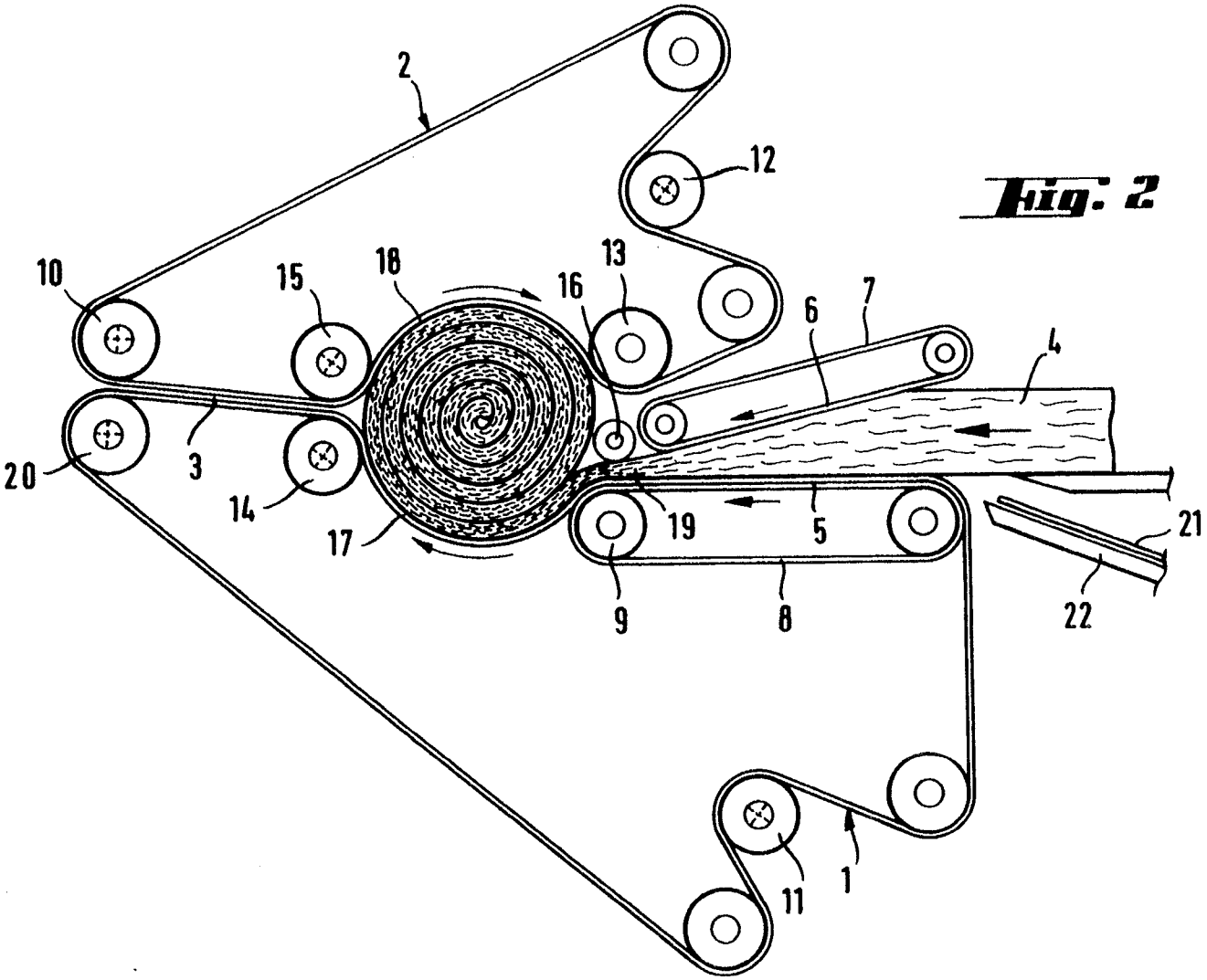
FIG. 2 shows winding in progress.

The operation for winding the compressed fibrous mat up on itself can be followed in FIG. 2. By comparison with FIG. 1 it can be seen that the mobile rollers 14 and 15 have moved towards the left and that the roller 16 is in such a position, relative to the roller 9, that it maintains the pressure on the mat which has just been compressed by the two rectilinear parts 5 and 6 of the pressing belts. Here, the sections 17 and 18 of the rolling belts 1 and 2 surround the periphery of the roll of compressed mat under tension. It can be noted from FIG. 2 that the compressed roll is held under pressure over practically its entire periphery by the set of four rollers, and by the portions 17, 18 of belt which surround it. At each moment, the computer calculates the theoretical dimension of the cylinder with a spiral directrix which constitutes the periphery the compressed roll. This dimension is a function, on one hand, of the compression coefficient which it has been decided to apply to the mat, and therefore finally its thickness in the compressed state and, on the other hand, of the length of mat already wound. Since the rollers 9 and 13 are fixed, it is the position of the rollers 14 and 15 which defines the cylinder in question, the length of the curved walls 17 and 18 of the cavity being defined by the position of the tensioning rollers 11 and 12, itself determined by the computer.

The wrapping of the compressed roll is carried simultaneously with the winding of the last turn of compressed mat. The same materials as usual are used for the wrapping, such as kraft paper, or plastic films, made for example, from polyethylene. The strips of film intended to wrap the products are precut and precoated with adhesive.

In FIG. 2 the wrapping materials can be seen in readiness at 21 on the dispenser 22 which will cause them to advance at the desired instant so that they come into contact with fibrous mat before its compression. Coating with adhesive has been carried out at the two ends, on the upper face. As soon as the film comes into contact with the mat, it adheres to it and is entrained about the compressed roll. The film is of a length such that it overlaps the rear of the end of the mat. Its adhesive-coated face may thus pass through the set of conveyor belts and rollers without adhering thereto and the film finishes by adhering to itself. It can thus be seen that the wrapping operation is done practically completely in parallel time, that is to say that it does not last any longer than the winding of the last turn.

Figure 3:
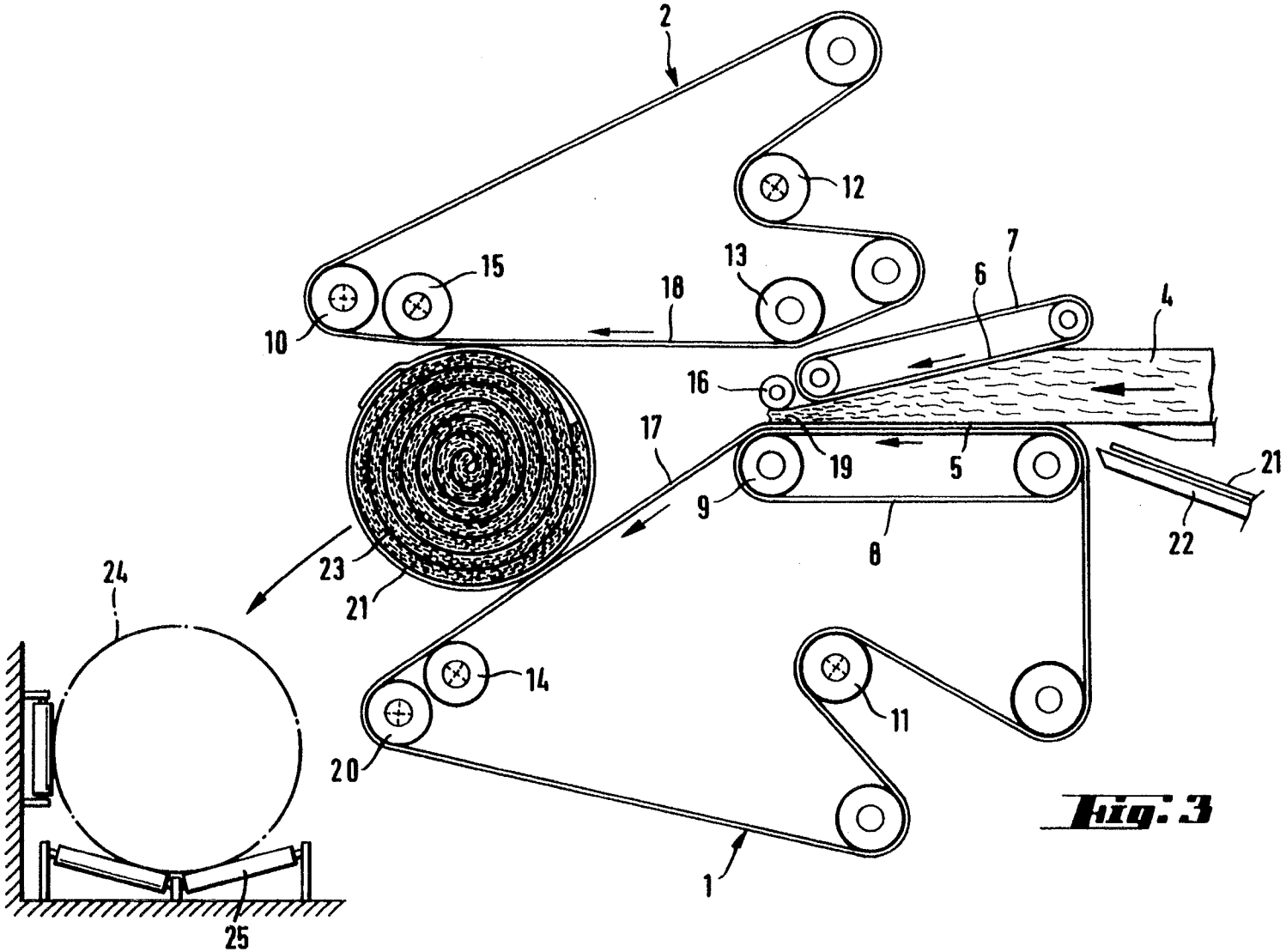
FIG. 3 shows the removal of the compressed roll of the invention at the end of the winding operation.

The next operation is the removal of the wrapped roll. It is shown in FIG. 3 where a general movement of the belt 1 can be caused by the roller 20 which, until that moment, was immobile and which at this time moves downwards so as to free the passage for the compressed and wrapped roll 23, which comes to occupy the position 24 on the conveyor 25 which removes it. As soon as the roll 23 has left the winder, the belt 1, guided by the roller 20, reassumes the position which it occupied at the beginning of the operation in FIG. 1. The rollers 14 and 15 also come into their original position and the operation can recommence immediately. It can thus be seen that the non-productive time which separates the end of the winding of one roll and the beginning of the winding of the next roll is very short since in the device shown in FIGS. 1, 2 and 3 it is sufficient for the roller 20 to move away from the roller 10 and then to return to its original position while the rollers 14 and 15 also make the same return journey. This operation may be carried out in a few fractions of a second.

Figure 4:
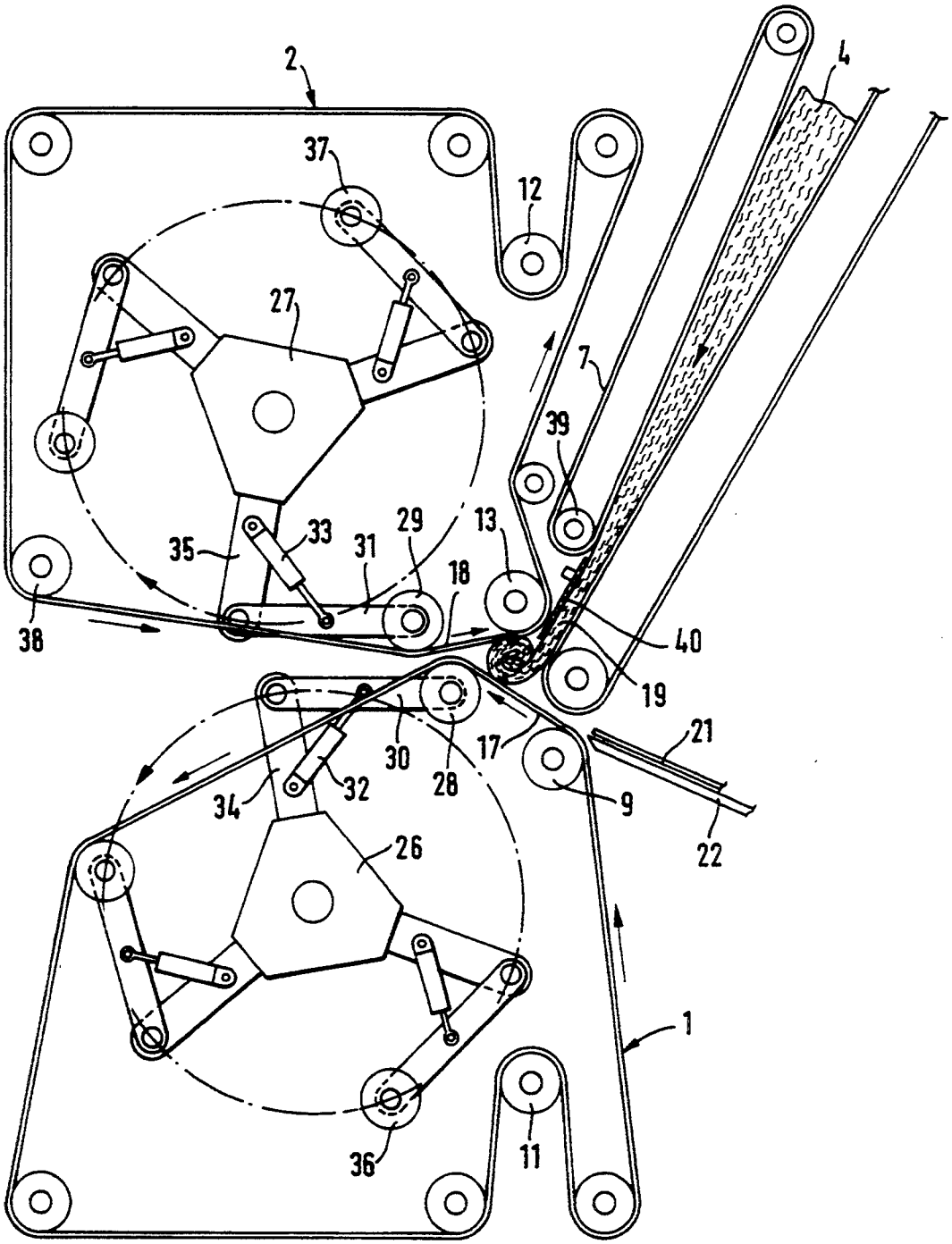
FIGS. 4 and 5 show a variant of the winder of the invention.
Figure 5:
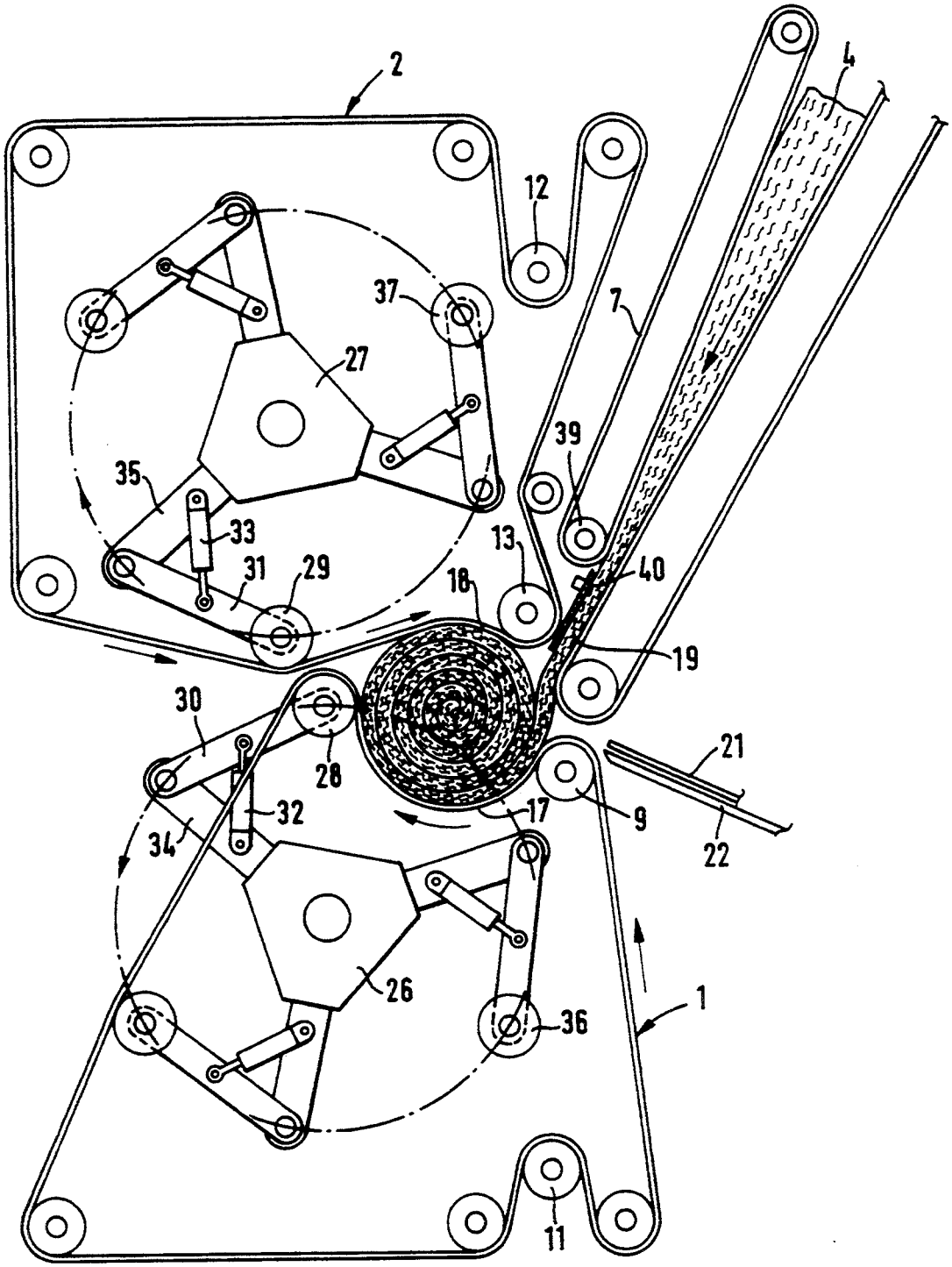

FIGS. 4 and 5 show a variant of the invention which uses two carousels, respectively 26 and 27, for obtaining the movements of the rollers supporting the belts 1 and 2. Each of these carousels has two flanges between which rollers are fixed, which rollers will each in turn support the belts 1 and 2. Each of these flanges of the carousels comprises three radial arms spaced at 120° from one another. At the ends of these arms there are fixed levers which, in turn, carry at their ends the rollers which support the belts 1 and 2. The levers move away from the axis of the carousels to greater or lesser extent by virtue of jacks.

Out of the three rollers which each carousel carries, one alone is active at a given instant. In the figures, these are the rollers 28 and 29. They are supported respectively by the levers 30 and 31, actuated by the jacks 32 and 33, and themselves supported by the radial arms 34 and 35. The function and the movement of the rollers 28 and 29 is exactly the same as that of the rollers 14 and 15 of FIG. 1. The two carousels 26 and 27 are given a synchronous movement but their speed is not constant.

It is such that, as previously, the rollers 9, 13, 28 and 29 are in such a position that belt 1 and belt 2 make up the theoretical figure which defines the compression of the fibrous mat wound up on itself. If the diameters of the rollers are small, all four of them can be tangential to the same figure. Otherwise, as in FIGS. 4 and 5 only three of them have enough room to be there.

When the compressed roll has been made up and wrapped the jacks 32 and 33 are rapidly actuated so as to move the rollers 28 and 29 close to the axes of the carousels, which allows the finished compressed mat rolls to be removed. At that instant it is the turn of the next rollers on the carousels, namely 36 and 37, to come into action. They are rapidly brought close to the rollers 11 and 13 so as to create a new cavity in which the compressed fibrous mat can start to be wound by virtue of the action of the roller 13. It can be seen that in this variant of the winder of the invention all the non-productive time between the end of one operation and the beginning of the next operation is eliminated.

In the configuration of FIG. 4 and 5 the drive rollers are the roller 9 for the belt 1, the roller 39 for the conveyor belt 7, and the roller 38 for the belt 2. The speed of these three rollers is constant, and the rotational speed of the two carousels, the position of the two jacks 32, 33 and the position of the tensioning rollers 11 and 12 are determined by the central computer of the device.

The variant of FIGS. 4 and 5 therefore has the advantage of allowing two pairs of rollers 36 and 37 to immediately succeed the rollers 28 and 29 which have just left by the other side, without non-productive time.

On the same FIGS. 4 and 5, there is a device which maintains the pressure on the compressed mat between the place where it leaves the upper pressing conveyor belt 7 and the place where it reaches the previous turn 41 of the roll. This device is for instance made of a metal plate 40 which is held by a rod located between rollers 39 and 13.

In order to test the advantages which the invention makes it possible to obtain, its operation has been compared with that of a winder of the type described in patent EP 294 290. Tests were carried out with a mat with a width of 1 m entrained at the maximum speed of the winder of the prior art, that is to say 150 m per minute with a mat thickness of 300 mm and a specific mass of 10 kg/m$^3$ which also corresponded to the maximum possible with the winder of the prior art, that is to say a compression ratio of 6/1. The finished roll had a diameter of 500 mm. The operational characteristics of the winder according to the invention were the same as those of the winder of the prior art.

| | prior art | invention |
|---|---|---|
| winding time | 3 sec | 3 sec |
| wrapping time | 1.5 sec | 0.5 sec |
| removal time | 2.5 sec | 1.5 sec |
| waiting time | 1.5 sec | 1 sec |
| Total | 8.5 sec | 6 sec |

The table displays the results obtained. The most spectacular progress relates to the wrapping time: this is due to the fact that the winder of the invention executes this in parallel time, in other words wrapping is performed at the same time as winding the last turn of the compressed mat.

The overall results therefore show a saving of the order of 25% in the time necessary for compressing and winding a given compressed roll. This advantage in duration is accompanied by an improvement in the quality since the compression of the mat is carried out without relative slip between the latter and the pressing members as was the case in U.S. Pat. No. 4,602,471. The improvement is all the more significant if the winder of the invention is compared to the winder in which winding was carried out between two planes defined by conveyor belts, for with this system the fibers are subjected to repeated compression/decompression actions which bring about breakage of the fibers and binder fatigue. The compressed roll of the invention, with, for the first time, compression ratios greater than 10/1 obtained directly on the winder without damage to the mat which recovers its original thickness and qualities has the advantage, as compared with the rolls of the prior art, of an economy of wrapping, transport and storage.

Moreover, the shorter non-productive times of the machine of the invention make it possible to reduce the ratio necessary between the line speed and the winding speed. This ratio, up till now, was from 2 to 2.5 and it decreases to 1.3–1.5 on the new machine. This makes it possible either to wind a given product for a given line speed at a lower winding speed and therefore to further improve the quality of winding, or to wind a given product at a winding speed (which can be as much as 200 m/min) greater than the maximum speed which was allowed up until now (150 m/min). This allows a saving in capital investment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A winder for winding up a flexible band comprised of a compressed fibrous mat, comprising:

first and second driven belts forming a cavity into which the band may be fed to wind the band; and means for feeding the band into the cavity in a feeding direction to wind said band, including means for compressing the band prior to the band entering the cavity, wherein said compressing means comprises elements forming planes moving toward the cavity and having a spacing which decreases toward the cavity, wherein said driven belts are sized and supported such that said first and second driven belts conform to the shape of a band being wound in the cavity and provide a substantially constant pressure over substantially the entire periphery of the band in the cavity.

2. The winder of claim 1 including means for discharging the wound band from the cavity such that the wound band moves in the feeding direction.

3. The winder of claim 1, including means for maintaining the compressed band in a compressed state in the cavity.

4. The winder of claim 3, wherein the means for maintaining comprises a metal plate.

5. The winder of claim 1, including four rollers supporting said belts so as to define the cavity.

6. The winder of claim 5 including means for starting the winding of the band.

7. The winder of claim 6, wherein said starting means comprises another roller.

8. The winder of claim 6, wherein at any moment at least three of said four rollers are tangential to a cylinder whose directrix has substantially the shape of a spiral corresponding to a threshold envelope of the wound band at that moment.

9. The winder of claim 5, including means for separating two of said rollers to discharge the wound band.

10. The winder of claim 9, including means for positioning two additional rollers adjacent one another to define a new cavity simultaneously with the separation of said two separating rollers.

11. The winder of claim 10, wherein the two separated rollers and said two additional rollers are mounted on a carrousel.

12. The winder of claim 1, including means for attaching a wrapping film to an end of the wound band such that the wound roll is wrapped at the end of a winding operation.

13. The winder of claim 12, wherein the wrapping film has a length greater than a circumference of the wound band.

14. The winder of claim 1, including a support belt in said feeding means.

* * * * *